US005519416A

United States Patent [19]

Hayasaki et al.

[11] Patent Number: 5,519,416

[45] Date of Patent: May 21, 1996

[54] RECORDING APPARATUS WITH CASCADE CONNECTED INTEGRATED DRIVE CIRCUITS

[75] Inventors: Kimiyuki Hayasaki, Yokohama; Masaya Kikuta, Tokyo; Akira Katayama, Yokohama; Hideaki Kishida, Yamato, all of Japan

[73] Assignee: Canon Kabushiki Kaisha, Tokyo, Japan

[21] Appl. No.: 50,627

[22] Filed: Apr. 22, 1993

[30] Foreign Application Priority Data

Apr. 23, 1992 [JP] Japan ..... 4-104776

[51] Int. Cl.[6] ..... B41J 2/05

[52] U.S. Cl. ..... 347/13

[58] Field of Search ..... 347/12, 13, 15, 347/57–59, 180–182; 346/76 PH; 358/296, 298

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 5,043,748 | 8/1991 | Katayama et al. | 346/140 R |
| 5,173,717 | 12/1992 | Kishida et al. | 346/1.1 |
| 5,262,801 | 11/1993 | Serizawa | 358/298 |

FOREIGN PATENT DOCUMENTS

| | | | |
|---|---|---|---|
| 0110675 | 6/1984 | European Pat. Off. . | |
| 0394910 | 10/1990 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 63-137848 | 6/1988 | Japan | 347/12 |
| 2-281973 | 11/1990 | Japan | 347/13 |
| 3-032159 | 2/1991 | Japan . | |
| 3-117913 | 5/1991 | Japan . | |
| 4-219014 | 8/1992 | Japan . | |
| 1200388 | 12/1985 | U.S.S.R. . | |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A recording apparatus includes a plurality of recording elements a plurality of drive ICs, in which a plurality of drive signal lines containing a signal line for an image data signal and a signal line for a transfer clock which transfers the image data signal are connected in cascade. Each drive IC supplies a recording current selectively to the recording elements in correspondence to the image data signal. A transfer clock control circuit, which is located at an input part of the transfer clock in the recording apparatus, controls a duty of the transfer clock supplied to the drive ICs so that a duty ratio of the transfer clock at the final stage of the plurality of drive ICs is enough to transfer the image data signal.

29 Claims, 10 Drawing Sheets

RECORDING APPARATUS WITH CASCADE CONNECTED INTEGRATED DRIVE CIRCUITS

BACKGROUND OF THE INVENTION

1. Field of the Invention

The present invention relates to a recording apparatus having a plurality of integrated drive circuits (hereinafter referred to as drive ICs) on the order of several tens and having a plurality of recording elements corresponding to the length of a single line on which information is recorded, and specifically to a recording apparatus categorized in a line-type recording apparatus in which clock signal lines of drive ICs are connected in a cascade configuration.

In addition, the present invention is preferable for forming an ink jet recording apparatus and a thermal printer, used as an output terminal for a word processor, a facsimile, a copying machine, a computer and the like, having heat generation elements used as recording elements.

2. Description of the Background Art

In the prior art, many kinds of line-type recording apparatuses are known which comprise a linear array of a plurality of recording elements. The line-type recording apparatus has several tens of pieces of drive ICs on an identical board, which can generally drive a block of several tens of recording elements simultaneously. With respect to the installation of the drive ICs on the board, a method is known in which drive control signal lines for transmitting image data signals to be supplied to the drive ICs are connected to the first block to the final block of the drive ICs in cascade.

FIG. 1 shows a circuit structure of the line-type recording apparatus in the prior art described above, and FIG. 2 is a detailed structure of the inside of the drive IC enclosed by broken lines in FIG. 1. A reference numeral 1 designates a recording element, to which a recording current is led in response to individual image data signals. A reference numeral 4 denotes a shift register, in which serial image data (SI) corresponding to a single line of recording elements are shifted sequentially with a transfer clock (SCKI). After the transfer of the image data, the image data are loaded into latch circuits 3 by a latch input (LATI) that triggers the latch circuits 3. So far, the image data are prepared for individual recording elements 1.

Now that the image data are prepared for the individual recording elements 1, recording currents are supplied to designated recording elements by activating gate circuits 2. In general, it is necessary to determine electric current supply conditions by considering the characteristics of the recording elements 1 and the recording apparatus itself. With respect to the recording elements 1, the pulse width of each supplied current is so determined that an optimal condition for current supply may be established when supplying the electric current. With respect to the recording apparatus, there is a method in which the recording elements are driven by group in order to distribute the power load applied to the recording elements. A reference numeral 22 in FIGS. 1 and 2 denotes a D-type flip-flop circuit which enables to drive the recording elements by group, each group corresponding to an individual drive IC, in response to the group drive signal (EI) and the group drive signal transfer clock (ECKI). The logical AND of the pulse width (BEI) of electric current supplied to the recording element 1 and the output of the D-type flip-flop circuit 22 is obtained by a gate circuit 21 and an optimal recording current to the recording element is supplied through the gate circuit 21.

In order to increase the image recording speed, the frequency of the image data signal transfer clock (SCKI) for transferring serial image data corresponding to the number of the recording elements 1 is generally determined to be several MHz or more.

So far, by connecting drive control signal lines of drive ICs in cascade, a recording apparatus can be formed with a large number of recording elements, such as several thousand recording elements, arranged in a long single line.

However, in the prior art described above, a recording apparatus with a long-sized array of recording elements, which is formed by connecting drive control signal lines of drive ICs in cascade, requires the clock duty of the input and output waveforms that may change on the order of several nano-seconds, especially when a drive IC is used whose image data signal transfer clock frequency is about 10 MHz. In addition, as the waveforms of input and output signals are susceptible to stray capacitance developed by wiring between the drive ICs, the clock duty of the input and output signals is gradually shifted to the "High" level or to the "Low" level in response to the characteristic of the drive ICs.

For example, assuming to form a recording apparatus having a long-sized array of recording heads for recording images on a A3-sized sheet with a resolution of 400 dpi, it is required to connect 74 drive ICs in cascade, each drive IC corresponding to a block of 64 recording elements. In such a recording apparatus, in the case where the clock duty of the image data signal transfer clock changes gradually, the waveform of the clock signal observed near the final stage of drive ICs may eventually be shifted and fixed at the "High" level or the "Low" level, which leads to failure of correct transmission of the image data.

FIGS. 3 to 6 illustrate switching waveforms of the serial image data (SI) and the image data signal transfer clock (SCKI) in order to illustrate the clock duty change in these signals. FIG. 3 shows a relationship between the image data SI and the clock signal SCKI of the shift register 4 in the drive IC, where "n" is the number of recording elements. When the clock signal SCKI is applied to the logic terminal of the drive IC, as shown in FIG. 4, the waveform of the output signal lengthens by the rise time tr and the fall time tf with respect to its original input signal. The circuit structure of the shift register 4 of the drive IC is shown in FIG. 2, where the clock signal SCKI is outputted through a couple of inverters. In the event that the threshold level at which the clock signal SCKI changes from Lower-level to Higher-level is, for example, between 2.1 V and 2.4 V which is less than ½ $V_{DD}$, the clock duty at High-level gradually increases as shown in FIG. 5. The details of this phenomenon will be described below.

In FIG. 5, VT is a threshold level corresponding to a single IC, and its value is assumed as follows:

$VT < \frac{1}{2} V_{DD}$, and $V_{DD} = 5.0$.

When the clock signal SCKI-1 of the No. 1 drive IC changes from Low-level to High-level, the level of the clock signal SCKO-1 of the No. 1 drive IC begins to increase at the time when the level of the clock signal SCKI-1 reaches $V_T$. The time period required for the clock signal SCKO-1 of the No. 1 drive IC to change from Low-level to High-level, or from High-level to Low-level corresponds to the tr and tf (see FIG. 4) defined in the standard value of the drive IC. Similarly, when the level of SCKO-1 of the No. 1 drive IC reaches $V_T$, the level of SCKO-2 of the No. 2 drive IC begins to increase.

As discussed above, as the input waveform of the clock signal SCKI travels through the drive ICs connected in series, the duration during which the High-level signal is maintained lengthens, and hence the waveform of SCKI may be fixed at High-level. In the case where the waveform of SCKI is fixed at High-level completely, since data can not be shifted (sampled) until the next leading edge is developed, there may be failures in printing images such as a black noisy stripe is overlapped on the original image and even the whole recording area is painted in black. Thus, due to the phenomenon in which the input waveform of the clock signal SCKI changes while traveling through the drive ICs connected in series, the image data SI can not be shifted at the leading edge of the clock signal SCKI as shown in FIG. 6.

In order to solve the above problem, in the prior art recording apparatus having a long-sized recording head, the state in which the image data can not be transferred due to the clock duty change is avoided by dividing the input image data and the input image data transfer clock into two components, respectively, or by configuring only clock wiring in parallel. In either case, the cost of the recording apparatus formed in the above manner is relatively high because an increasing number of input terminals and conductive layers formed on the board is required.

SUMMARY OF THE INVENTION

It is an object of the present invention to provide a low-cost and highly reliable recording apparatus which enables to transfer image data to the recording elements in a simplified structure.

It is another object of the present invention to provide a recording apparatus which enables to transfer image data to a long-sized recording head with certainty.

It is a further object of the present invention to provide a recording apparatus which enables to reduce the number of signal lines to be connected to recording heads.

In order to attain the above object, an aspect of the present invention provides a recording apparatus, comprising:

a plurality of recording elements;

a plurality of drive ICs, in which a plurality of drive signal lines containing a signal line for an image data signal and a signal line for a transfer clock signal which transfers the image data signal are connected in cascade, the drive IC used for supplying a recording current selectively to said recording elements in correspondence to the image date signal; and transfer clock control means for controlling a duty of the transfer clock supplied to the drive IC so that a duty ratio of the transfer clock at the final stage of the plurality of drive ICs is enough to transfer the image data signal.

In another aspect of the present invention, the transfer clock control means is assigned to every one block of the drive ICs or assigned to every set of a plurality of blocks of the drive ICs.

In another aspect of the present invention, the transfer clock control means corrects the duty ratio in response to the state of the transfer clock at the output signal terminal of the final stage of the drive ICs or at the output signal terminal of every block of the drive ICs.

In the present invention, since the transfer clock control means corrects the duty ratio of the transfer clock which transfers the image data signal when supplying the transfer clock to the recording apparatus so that the duty ratio of the transfer clock at the output terminal from the final stage of the drive ICs is enough to transfer the image data signal, it will be appreciated that the image data can be transferred in a simplified structure of the recording apparatus and its circuits.

In addition, in the present invention, by means of connecting a clock duty control circuit for correcting the duty ratio of the transfer clock to every N-block ($N \geqq 1$) of the drive ICs, it will be appreciated that clock duty changes can be reduced.

It may be allowed that the clock duty control circuit controls the correction of the clock duty ratio by monitoring the output signal of the transfer clock defined at the final stage of the drive ICs or at every N-block of the drive ICs.

According to the present invention, the following effects can be obtained.

As the transfer clock control circuit corrects a duty ratio of the transfer clock which transfer the image data when supplying the transfer clock to the recording apparatus so that a duty ratio of the transfer clock at the output terminal from the final stage of the drive ICs is enough to transfer the image data signal, it will be appreciated that the image data can be transferred in a simplified structure of the recording apparatus and its circuits, which enables to provide a low-cost and highly-reliable recording apparatus.

And by correcting the clock duty at every N-block ($N \geqq 1$) of the drive ICs, the clock duty changes can be reduced which enables reliable data transfer.

And furthermore, by correcting the clock duty ratio in responsive to the monitored signal of the transfer clock at the final stage of the drive IC or at every N-block of the drive ICs, the reliability of recording operation can be increased.

The above and other objects, effects, features and advantages of the present invention will become more apparent from the following description of accompanying drawings.

DETAILED DESCRIPTION OF PREFERRED EMBODIMENTS

Now, referring to the accompanying drawings, embodiments of the present invention will be described.

A. First Embodiment

Figure 1:
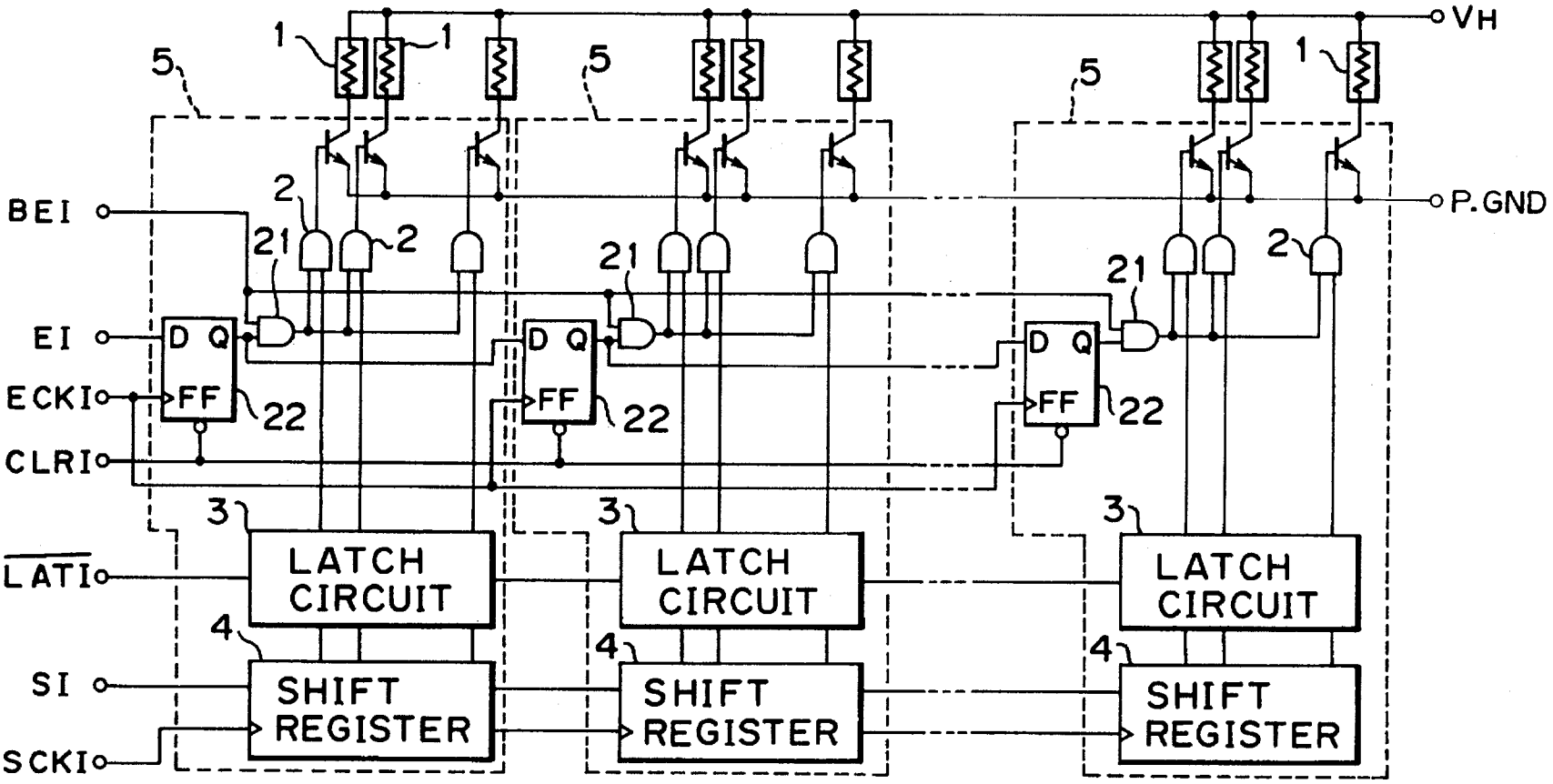
FIG. 1 (PRIOR ART)
FIG. 1 is a circuit diagram showing a circuit structure of a prior art recording apparatus.
Figure 2:
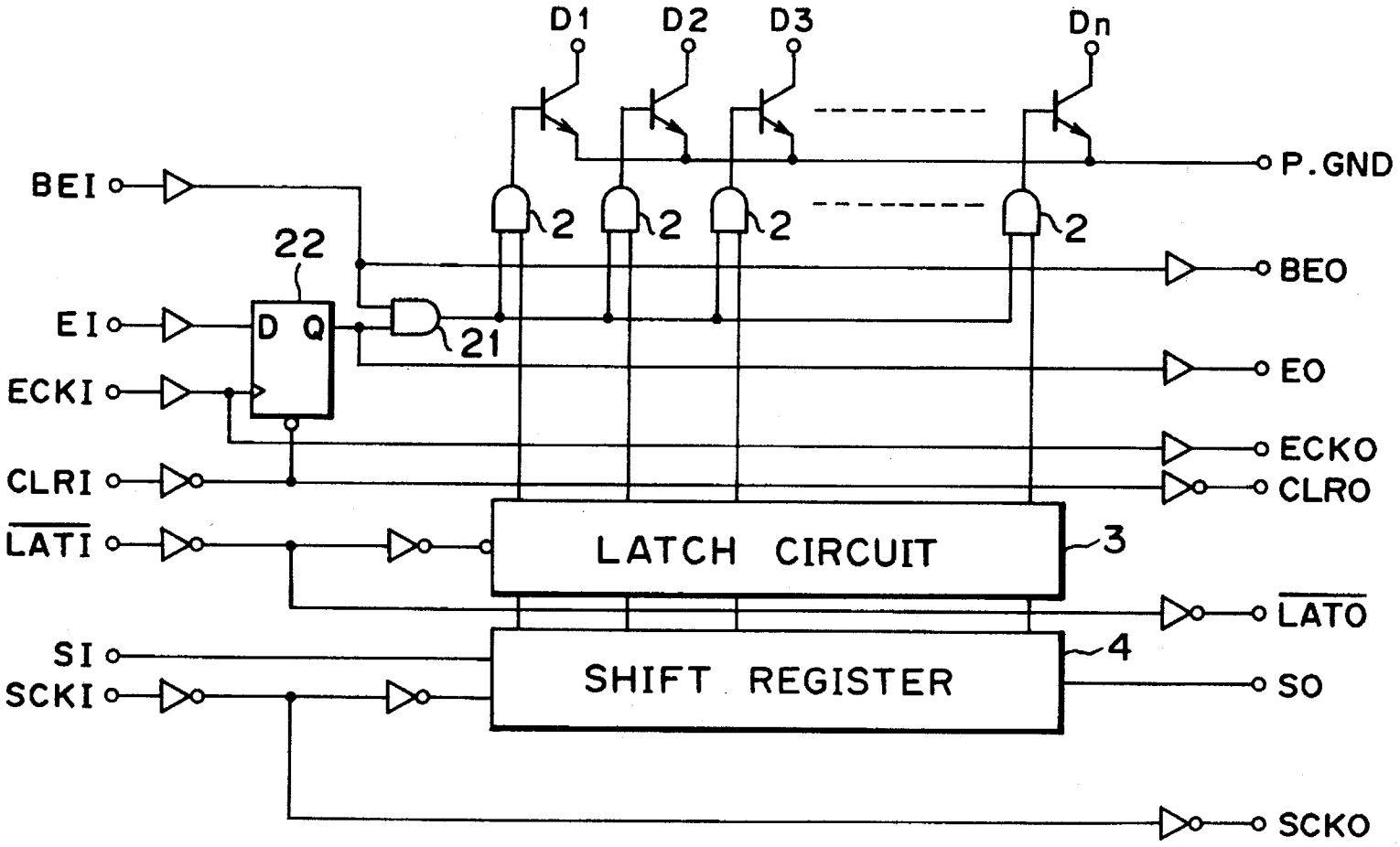
FIG. 2 (PRIOR ART)
FIG. 2 is a circuit diagram showing a circuit structure of a prior art drive IC in FIG. 1.
Figure 3:
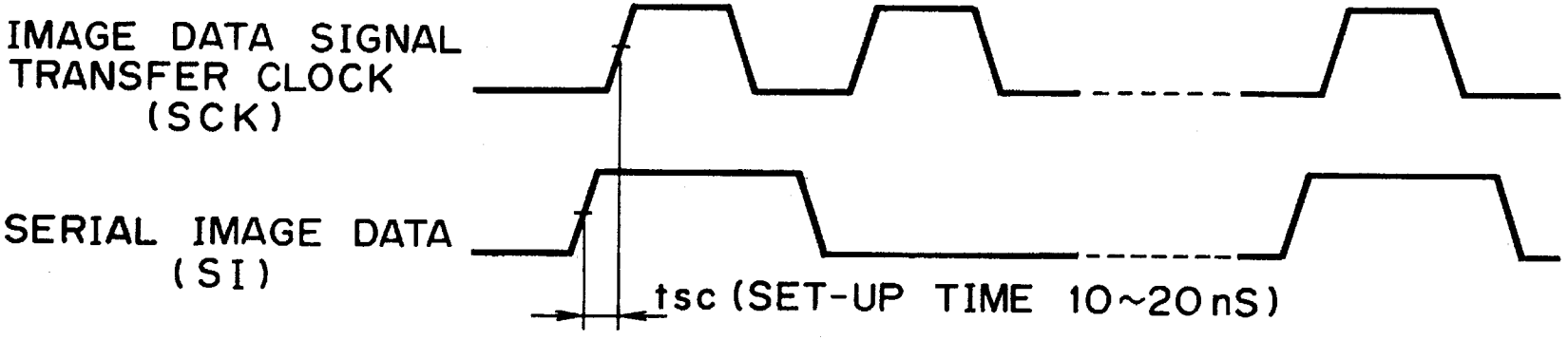
FIG. 3 (PRIOR ART)
FIG. 3 is waveforms showing a principle relationship between a data signal SI and a clock signal SCK in a shift register in FIG. 2.
Figure 4:
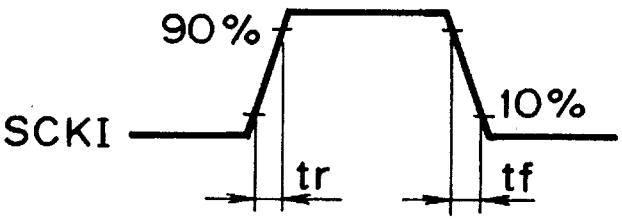
FIG. 4 (PRIOR ART)
FIG. 4 is a waveform showing a change of clock signal SCK brought by a prior art drive IC.
Figure 5:
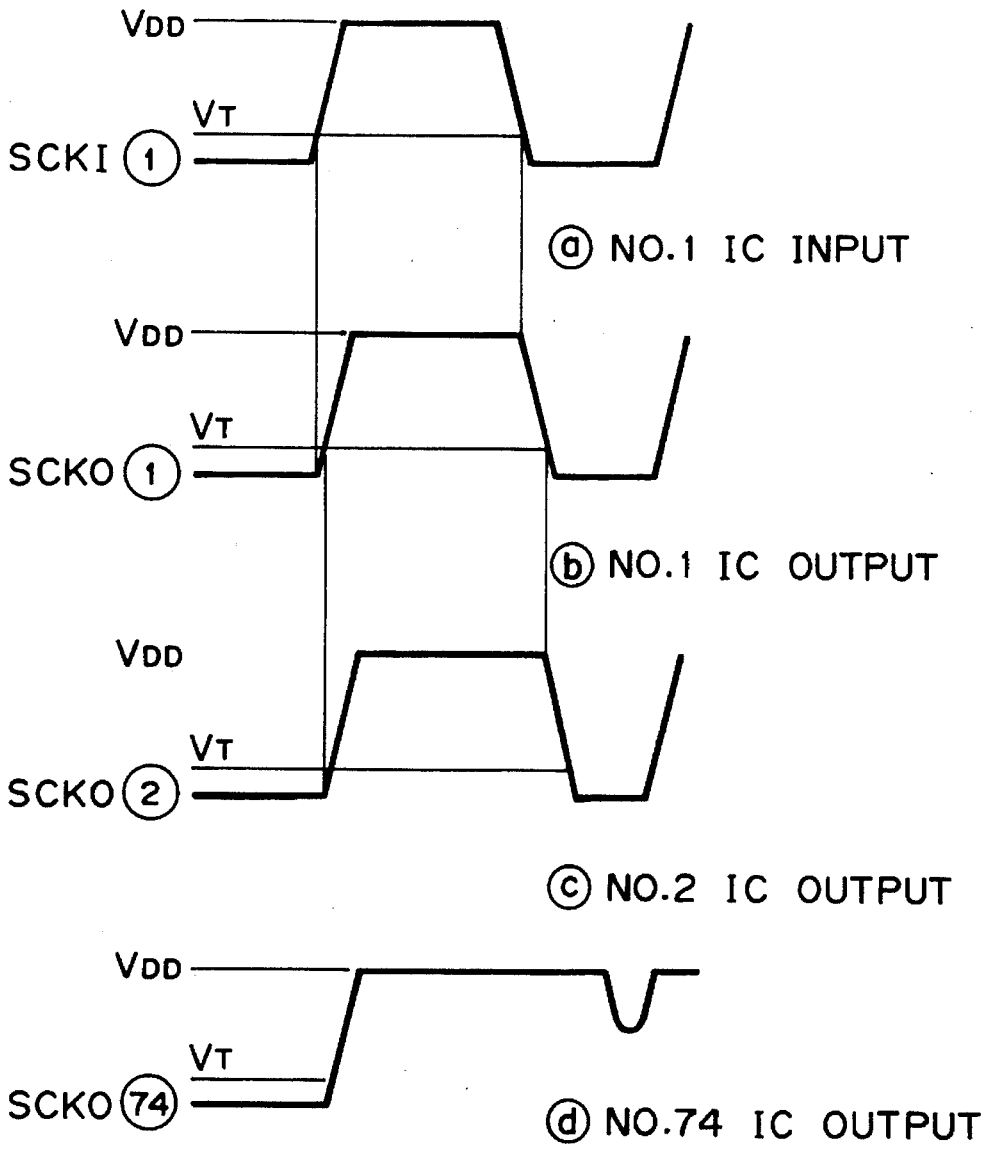
FIG. 5 (PRIOR ART)
FIG. 5 is waveforms showing a state of transitive changes of the input clock signal SCK as the signal passes through drive ICs.
Figure 6:
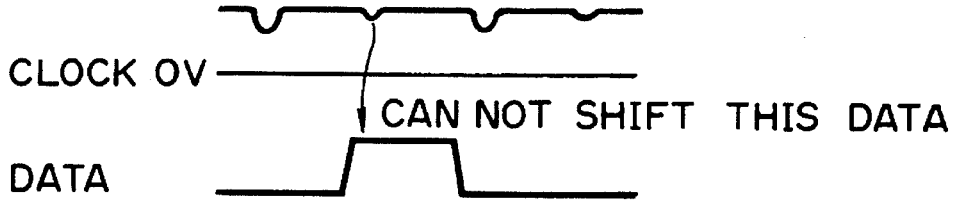
FIG. 6 (PRIOR ART)
FIG. 6 is waveforms showing a state in which a rise-up edge of the clock signal SCK can not shift the data SI due to the phenomenon illustrated in FIG. 5 in the prior art recording apparatus.
Figure 7:
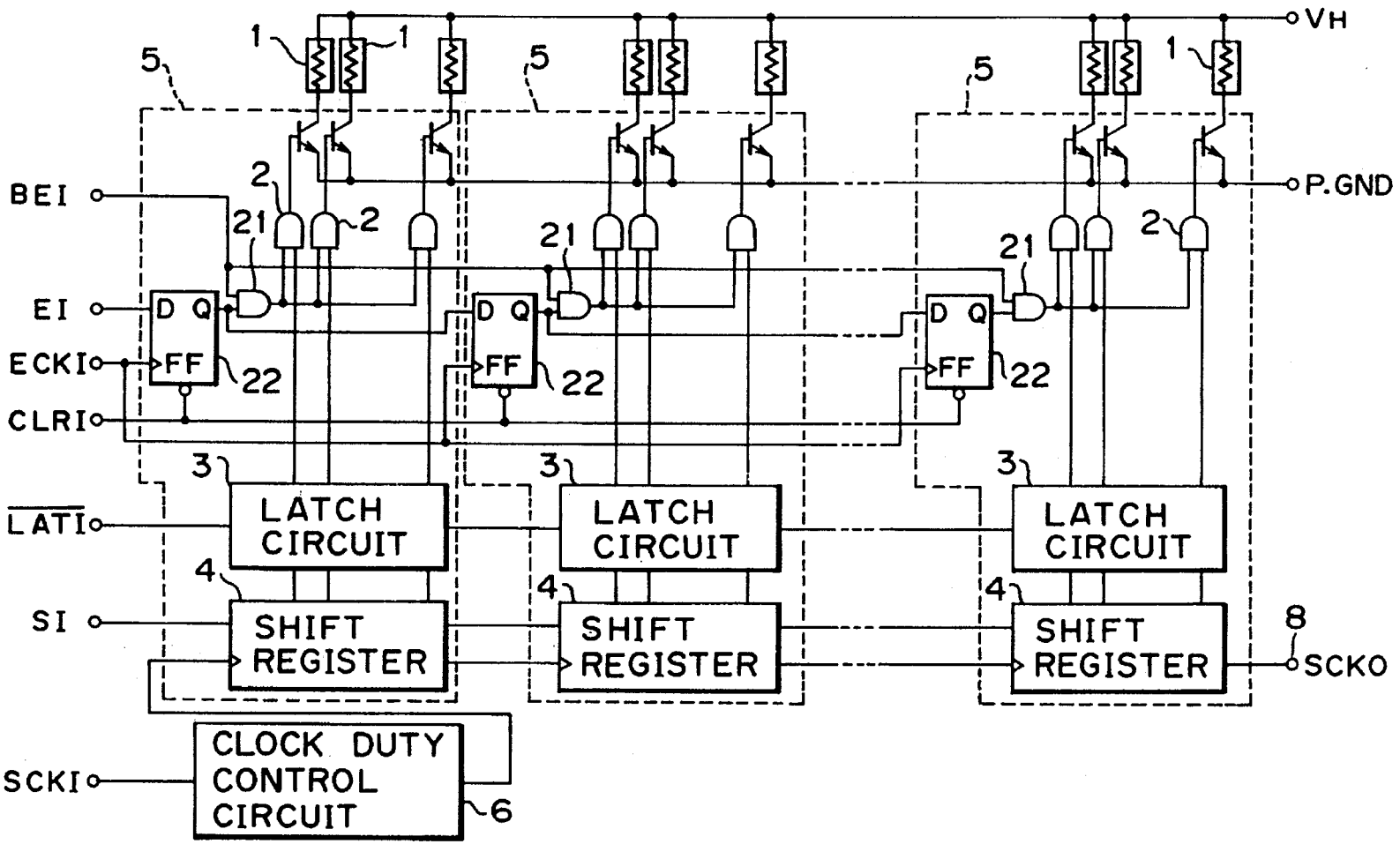
FIG. 7 is a circuit diagram showing a circuit structure of a recording apparatus in one embodiment of the present invention.

FIG. 7 shows a circuit structure of drive ICs in a recording apparatus in a first embodiment of the present invent ion. In FIG. 7, reference numeral 6 denotes a clock duty control circuit which is connected to a clock signal input terminal of the first stage shift register 4. The clock duty control circuit 6 modifies the duty ratio of the image data signal transfer clock SCKI such that the clock duty ratio of the image data signal transfer clock SCKO at an output terminal of the final stage shift register 4 of the drive ICs can transfer the image data signal SI.

The transfer clock signal SCKI is outputted from a clock generating circuit (not shown). The final stage shift register 4 is provided with an output terminal 8 to monitor the transfer clock signal SCKO.

Figure 8A:
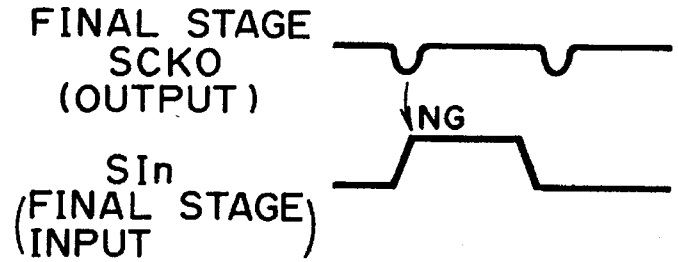
FIGS. 8A and 8B are waveforms showing changes in clock duty in the embodiment of the present invention.
Figure 8A:
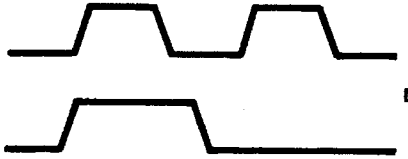
Figure 8B:
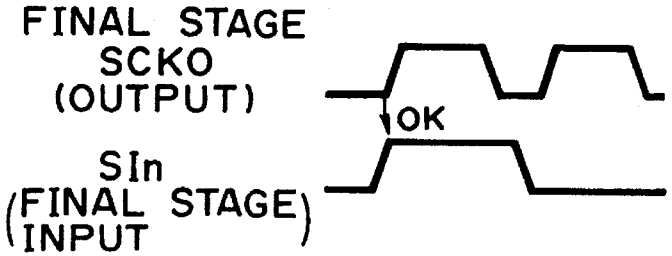
Figure 8B:
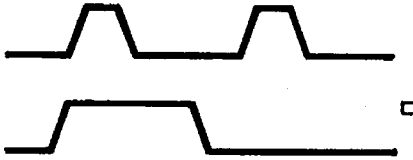

For example, in the case that the clock signal SCKO at the final stage is fixed at High-level with an ordinary duty ratio of 50% as shown in FIG. 8A, the clock duty ratio is modified to be 30% as shown in FIG. 8B. Practically, the clock duty is inevitably changed at the final stage of shift registers connected sequentially. Therefore, the clock duty of an input clock SCKI' is controlled by monitoring the output signal SCKO of the final stage, as shown in FIG. 8B, so that the output signal from the final stage of shift registers may be formed as a shiftable signal SCKO'. With this clock duty modification, image data can be transferred correctly.

Figure 9:
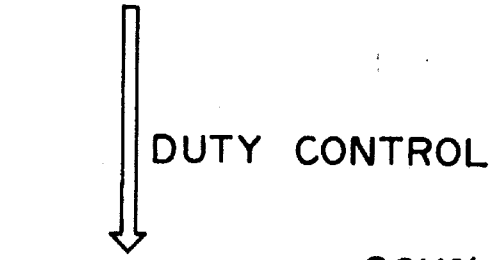
FIG. 9 is a waveform showing an example of a method for changing clock duty in the embodiment of the present invention.
Figure 9:
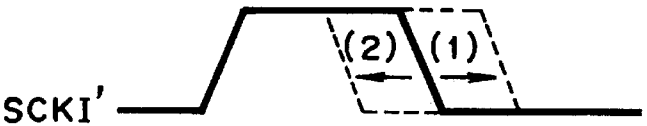

The clock duty control circuit 6 changes the pulse width of the clock by keeping the set-up time tsc to be constant in order to modify the clock duty as mentioned above. Though the same effect can be obtained by changing the rise time tr or the fall time tf of the clock, in this embodiment as shown in FIG. 9, the clock duty is modified by changing the pulse width by a one-shot multivibrator and so on or by adjusting the pulse width in designated values with a counter. In FIG. 9, (1) referring to the case that the clock waveform is fixed at the Low-level at the final stage of shift registers and (2) referring to the case that the clock waveform is fixed at the High-level at the final stage of shift registers indicate adjusting directions of the clock pulse width, respectively.

Figure 11:
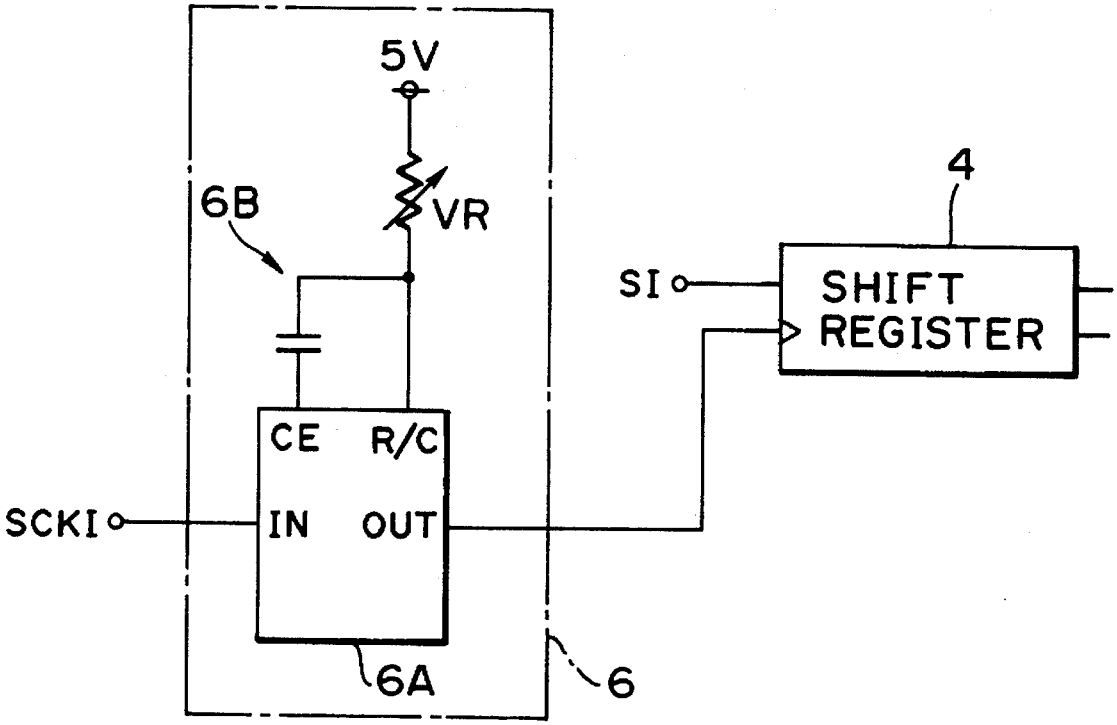
FIG. 11 is a circuit diagram showing an example of the structure of a clock duty control circuit in the embodiment of the present invention.

The clock duty control circuit 6 may be composed of, for example, a one-shot multivibrator IC 6A and a CR time constant circuit 6B connected outside to 6A as shown in FIG. 11. By changing the resistance $V_R$ of the CR time constant circuit 6B in order to modify the time constant, the clock duty can be controlled.

Figure 12:
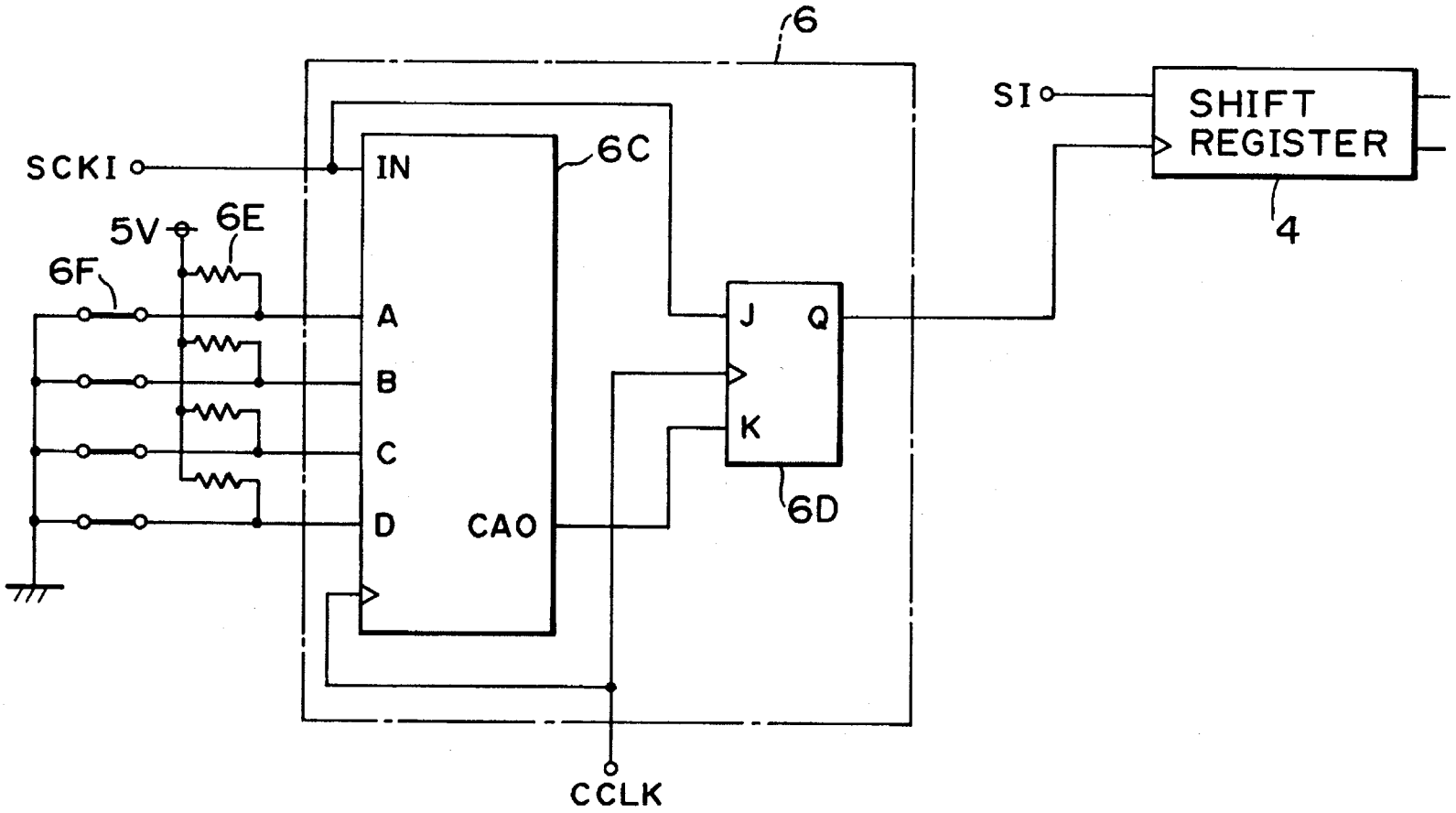
FIG. 12 is a circuit diagram showing another example of the structure of a clock duty control circuit in the embodiment of the present invention.

As shown in FIG. 12, it may be allowed that an n-bit (4-bit in this embodiment) counter 6C and a JK flip-flop (J/K FF) 6D are used as the clock duty control circuit 6. Preset terminals A to D of the counter 6C are connected to a pull-up resistance 6E and a wiring 6F for pattern cut, respectively. The counter 6C counts pulses of a counter clock CCLK the frequency of which is higher than the frequency of the image data signal transfer clock SCKI while the image data signal transfer clock SCKI is at High-level, and then supplies a carry signal from the CAO terminal at the time when the counted number of CCLK pulses reaches a value corresponding to a designated value defined by the pattern cut. As pull-up resistances 6E are connected to the preset terminals A to D, the preset terminal with its corresponding wiring 6F being cut is turned-on and kept at the High"1"-level. At the terminal Q of the J/K FF 6D, the output signal "1" is supplied when the terminal J, to which the image data signal transfer clock SCKI is supplied in synchronizing with the counter clock CCLK, is turned on with the signal "1", and the output signal from the terminal Q is turned off when the terminal K to which the carry is supplied is turned on with the signal "1". In other words, by varying the preset value with the designated pattern cut, the time period during which the output signal from the terminal Q is turned on with the High-level signal can be changed, and thus, the clock duty can be controlled.

Although, in the above embodiment, the output clock SCKO of the final stage shift register 4 is monitored, it may be possible to monitor the input clock SCKI of the final stage shift register 4. In brief, the clock SCKI can be monitored anywhere it is possible to make sure that the image data signal (SI) of the final stage shift register 4 is certainly transferred (shifted).

B. Second Embodiment

Figure 10:
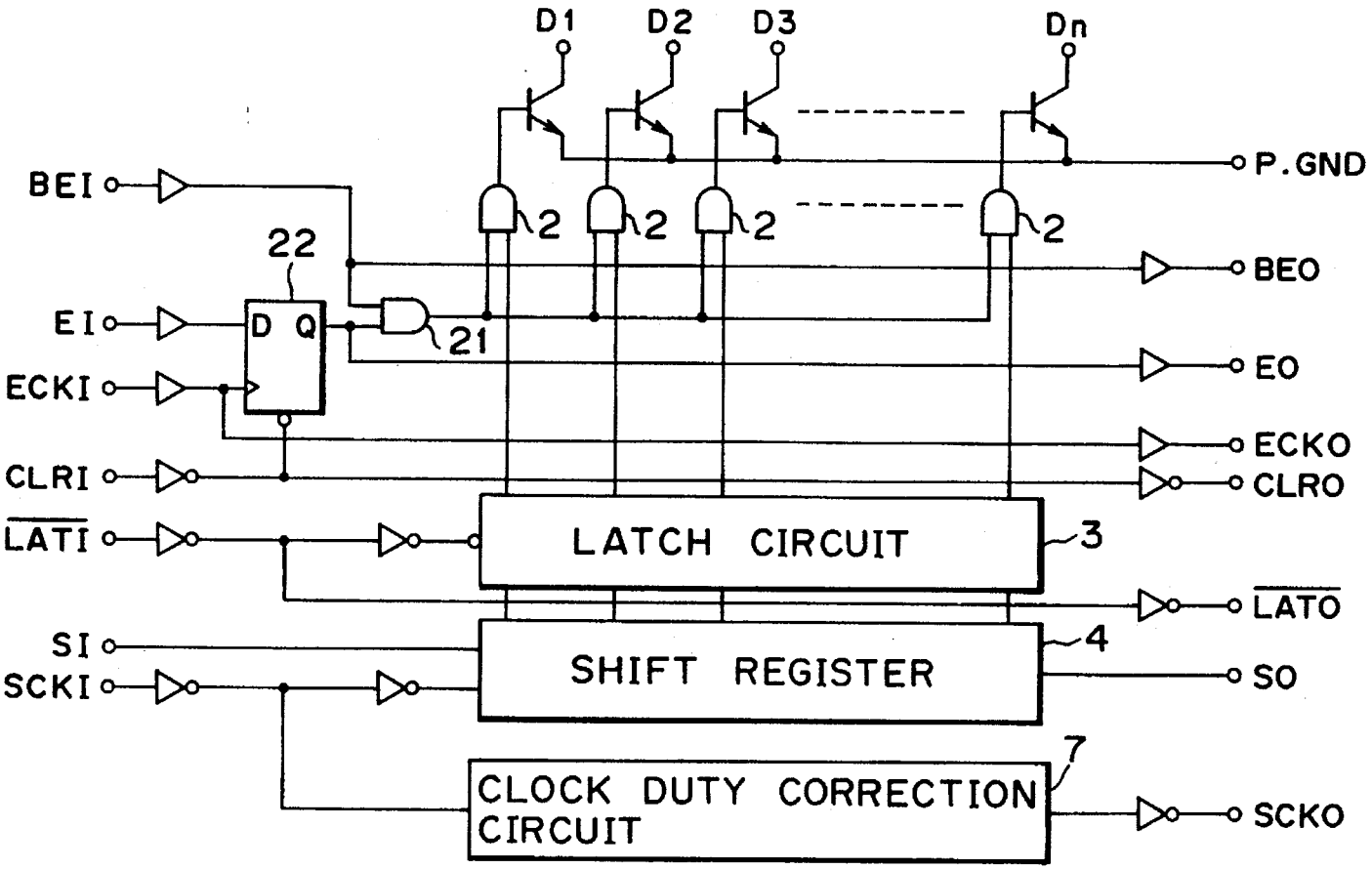
FIG. 10 is a circuit diagram showing a circuit structure of a drive IC in another embodiment of the present invention.

FIG. 10 shows a circuit diagram of a second embodiment of the present invention. In this embodiment, a clock duty correction circuit 7 is connected to every set of N blocks of drive ICs with $N \geqq 1$, in which N is 1 in this embodiment. The image data transfer clock SCKI supplied at the clock input terminal is led to the shift register 4 through a couple of inverter circuits within the drive IC. The output from the first stage of the inverter circuit is also supplied to the clock duty correction circuit 7, and the output from the correction circuit 7 is led to a later inverter circuit, and also, the output SCKO from the later inverter circuit is connected to the input terminal SCKI of the next drive IC connected in cascade. With this circuit structure, a clock duty change generated in the drive IC or due to the capacitance of connection wirings is corrected at every drive IC.

As for the structure of the clock duty correction circuit 7, for example, what is preferable is such a structure as changing the clock duty by using a one-shot multivibrator and a CR time constant circuit connected outside to the one-shot multivibrator and by modifying the number of the time constant of the CR time constant circuit, like the first embodiment. In this case, it may be preferable to form the CR time constant circuit so as to select a designated time constant and to modify the clock duty by selecting an optimum time constant in responsive to the structure and mechanism of the recording apparatus. In addition, it may be possible to form input and output terminals for n-bit data in the correction circuit 7 and to connect a plurality of correction circuits with these input and output terminals in cascade. In either case, as the clock duty change can be corrected within the drive IC, it will be appreciated that a reliable recording apparatus can be established only by installing drive ICs into the recording apparatus.

C. Another Embodiment

In another embodiment of the present invention, the clock duty can be corrected by monitoring the output of the image data signal transfer clock at the final stage of drive ICs or at every set of N blocks of drive ICs installed on the recording apparatus.

In the circuit configuration used in this case, the clock duty in the clock duty correction circuit is changed in response to clock duty changes monitored at the final clock output or at individual clock outputs. In order to simplify the circuit configuration, for example, it may be allowed that the clock duty change is corrected by forming a designated number of wirings with their disconnection pattern being selectable at every drive IC and by disconnecting arbitrary wirings for establishing a designated connection pattern in correspondence to the characteristic of the recording apparatus.

The present invention can be applied to the recording apparatus using a drive IC having a complex circuit structure for enabling to record gray-scaled images as well as the recording apparatus described in the above embodiments. The present invention can be applied also to a recording apparatus using such an installation method for drive ICs as the wire-bonding method and the flip-chip method. In addition, the present invention is not limited to be applied selectively to a recording apparatus used for specific purposes or with specific recording resolutions.

And furthermore, though in the above described embodiments, generation of the image data signal transfer clock SCKI and control of the clock duty of the clock SCKI are performed separately and independently, it may be easily understood that the clock duty of the clock can be controlled at the time of its generation.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Laid-Open Patent Application Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum width across a recording medium. Such a recording head may consists of a plurality of recording heads combined together, or one integrally arranged recording head.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Laid-Open Patent Application Nos. 56847/1979 or 71260/1985. The present invention is most effective when it uses the film boiling phenomenon to expel the ink.

Figure 13:
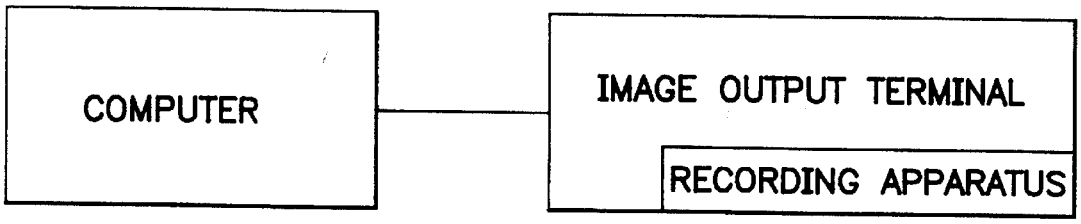
FIG. 13 is a schematic diagram of a computer system in which the recording apparatus of the present invention is incorporated.
Figure 14:
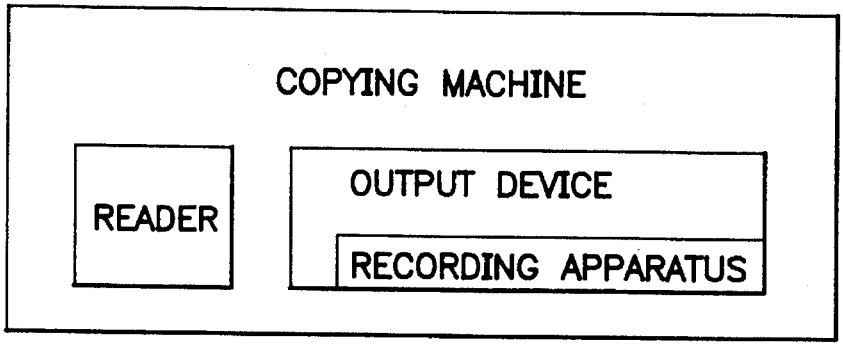
FIG. 14 is a schematic diagram of a copying machine in which the recording apparatus of the present invention is incorporated.
Figure 15:
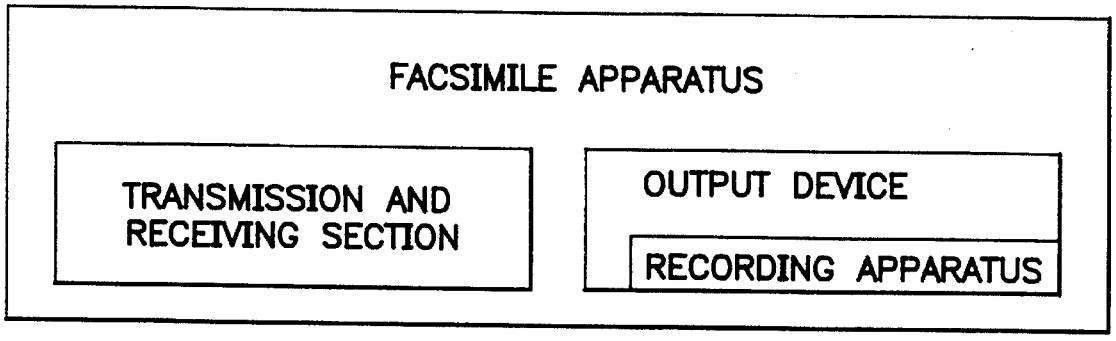
FIG. 15 is a schematic diagram of a facsimile apparatus in which the recording apparatus of the present invention is incorporated.

Furthermore, the ink jet recording apparatus of the present invention can be employed not only as an image output terminal of an information processing device such as a computer (FIG. 13), but also as an output device of a copying machine including a reader (FIG. 14), and as an output device of a facsimile apparatus having a transmission and receiving function (FIG. 15).

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A recording apparatus comprising:

a plurality of recording elements;

a plurality of ICs drive connected in a cascade, each of said drive ICs being input with a plurality of drive signal lines including a signal line for receiving an image data signal and a signal line for receiving a transfer clock signal which transfers the image data signal to a next one of said drive ICs, each of said drive ICs being configured for supplying a recording current selectively to at least a corresponding one of said recording elements according to the image data signal; and transfer clock control means for controlling a duty ratio of the transfer clock signal supplied to said drive ICs so that the duty ratio of said transfer clock signal at a final stage of said cascade is sufficient to transfer the image data signal.

2. A recording apparatus as claimed in claim 1, wherein said transfer clock control means is located at a commencement of said cascade and outputs the transfer clock signal to a first one of said drive ICs.

3. A recording apparatus as claimed in claim 1, wherein said transfer clock control means comprises means for generating the transfer clock signal and means for modifying the duty ratio of the transfer clock signal.

4. A recording apparatus as claimed in claim 3, wherein the generated transfer clock signal has a duty ratio of 50%.

5. A recording apparatus as claimed in claim 3, wherein the generated transfer clock signal has a duty ratio of 30%.

6. A recording apparatus as claimed in claim 3, wherein said modifying means comprises timer means for counting a period corresponding to a duty ratio from which an input timing of the generated transfer clock signal is to be modified.

7. A recording apparatus as claimed in claim 6, wherein said transfer clock control means comprises a one-shot multivibrator and a CR time constant circuit connected to said one-shot multivibrator.

8. A recording apparatus as claimed in claim 6, wherein said transfer clock control means comprises a counter and a JK flip-flop.

9. A recording apparatus as claimed in claim 8, wherein said counter comprises preset terminals corresponding to a designated number of bits, said preset terminals each being connected to a pull-up resistance and a pattern cut wiring.

10. A recording apparatus as claimed in claim 1, wherein said drive ICs have a terminal for monitoring the transfer clock signal at least at the final stage thereof.

11. A recording apparatus as claimed in claim 10, wherein said monitoring terminal is located at an output of the final stage of the drive ICs.

12. A recording apparatus as claimed in claim 10, wherein said monitoring terminal is located at an input of the final stage of the drive ICs.

13. A recording apparatus as claimed in claim 1, wherein a single said transfer clock control means is assigned to a block of said drive ICs.

14. A recording apparatus as claimed in claim 13, wherein said transfer clock control means comprises a one-shot multivibrator and a CR time constant circuit connected to said one-shot multivibrator.

15. A recording apparatus as claimed in claim 13, wherein said transfer clock control means comprises a counter and a JK flip-flop.

16. A recording apparatus as claimed in claim 15, wherein said counter comprises preset terminals corresponding to a designated number of bits, said preset terminals each being connected to a pull-up resistance and a pattern cut wiring.

17. A recording apparatus as claimed in claim 1, wherein one said transfer clock control means is assigned to each one of a plurality of blocks of said drive ICs.

18. A recording apparatus as claimed in claim 17, wherein each said block of said drive ICs comprises a terminal for monitoring the transfer clock signal at least at the final stage of said blocks of said drive ICs.

19. A recording apparatus as claimed in claim 18, wherein said monitoring terminal is located at an output of the final stage of each block of drive ICs.

20. A recording apparatus as claimed in claim 18, wherein said monitoring terminal is located at an input of the final stage of the drive ICs.

21. A recording apparatus as claimed in claim 17, wherein said transfer clock control means comprises a one-shot multivibrator and a CR time constant circuit connected to said one-shot multivibrator.

22. A recording apparatus as claimed in claim 17, wherein said transfer clock control means comprises a counter and a JK flip-flop.

23. A recording apparatus as claimed in claim 1, wherein said plurality of recording elements record by discharging ink, respectively.

24. A recording apparatus as claimed in claim 23, wherein said plurality of recording elements discharge ink, respectively, by utilizing thermal energy.

25. A recording apparatus as claimed in claim 1, wherein said recording apparatus is comprised in a facsimile apparatus having a communication function.

26. A recording apparatus as claimed in claim 1, wherein said recording apparatus is comprised in a copying machine having a reading function.

27. A recording apparatus as claimed in claim 1, wherein said recording apparatus is comprised in a computer system having a calculating function.

28. A driving circuit for driving a recording head having a plurality of recording elements, said driving circuit comprising:

a plurality of drive ICs connected in a cascade, each of said drive ICs being input with a plurality of drive signal lines including a signal line for receiving an image data signal and a signal line for receiving a transfer clock signal which transfers the image data signal to a next one of said drive ICs, each of said drive ICs being configured for supplying a recording current selectively to at least a corresponding one of said recording elements according to the image data signal; and transfer clock control means for controlling a duty ratio of the transfer clock signal supplied to said drive ICs so that the duty ratio of said transfer clock signal at a final stage of said cascade is sufficient to transfer the image data signal.

29. A method for driving a recording head having a plurality of recording elements by a driving circuit, said method comprising the steps of:

supplying the driving circuit with an image data signal; and supplying the driving circuit with a transfer clock signal, wherein said driving circuit comprises:

a plurality of drive ICs connected in a cascade, each of the drive ICs being input with a plurality of drive signal lines including a signal line for receiving the image data signal and a signal line for receiving the transfer clock signal which transfers the image data signal to a next one of the drive ICs, each of the drive ICs being configured for supplying a recording current selectively to at least a corresponding one of the recording elements according to the image data signal, and transfer clock control means for controlling a duty ratio of the transfer clock signal supplied to the drive ICs so that the duty ratio of the transfer clock signal at a final stage of the cascade is sufficient to transfer the image data signal.

* * * * *

UNITED STATES PATENT AND TRADEMARK OFFICE

CERTIFICATE OF CORRECTION

PATENT NO. : 5,519,416

DATED : May 21, 1996

INVENTOR(S) : Kimiyuki HAYASAKI, et al.

It is certified that error appears in the above-indentified patent and that said Letters Patent is hereby corrected as shown below:

On the title page, col. 2, item:

[57] ABSTRACT:

Line 2, "elements a" should read --elements and a--.

COLUMN 2:

Line 56, "VT<$^1/_2$ $V_{DD}$, and" should read --VT<$^1/_2$ $V_{DD}$ [V], and--;

Line 57, "$V_{DD}$=5.0." should read --$V_{DD}$=5.0 [V].--.

COLUMN 9:

Line 37, "ICs" should read --drive ICs--.

Signed and Sealed this

Tenth Day of September, 1996

Bruce Lehman

*Attest:*

BRUCE LEHMAN

*Attesting Officer*

*Commissioner of Patents and Trademarks*